US008978818B2

(12) United States Patent
Proske

(10) Patent No.: US 8,978,818 B2
(45) Date of Patent: Mar. 17, 2015

(54) MONOLITHIC FIREARM SUPPRESSOR

(71) Applicant: Curtis Proske, The Woodlands, TX (US)

(72) Inventor: Curtis Proske, The Woodlands, TX (US)

( * ) Notice: Subject to any disclaimer, the term of this patent is extended or adjusted under 35 U.S.C. 154(b) by 0 days.

(21) Appl. No.: 13/832,852

(22) Filed: Mar. 15, 2013

(65) Prior Publication Data

US 2014/0262604 A1 Sep. 18, 2014

(51) Int. Cl.
*F41A 21/30* (2006.01)

(52) U.S. Cl.
CPC ..... *F41A 21/30* (2013.01)
USPC ..... 181/223; 89/14.4

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 5,029,512 | A | 7/1991 | Latka | |
| 6,374,718 | B1 | 4/2002 | Rescigno et al. | |
| 6,575,074 | B1 | 6/2003 | Gaddini | |
| 7,073,426 | B1 * | 7/2006 | White | 89/14.4 |
| 7,587,969 | B2 | 9/2009 | Silvers | |
| 7,594,464 | B2 | 9/2009 | Dueck | |
| 7,856,914 | B2 | 12/2010 | Shults et al. | |
| 7,874,238 | B2 | 1/2011 | Silvers | |
| 7,931,118 | B1 * | 4/2011 | Cronhelm | 181/223 |
| 7,987,944 | B1 | 8/2011 | Brittingham et al. | |
| 8,015,908 | B2 | 9/2011 | Kline et al. | |
| 8,096,222 | B2 | 1/2012 | Silvers | |
| 8,104,570 | B2 | 1/2012 | Miller et al. | |
| D657,012 | S | 4/2012 | Woodell | |
| 8,162,100 | B2 | 4/2012 | Shults et al. | |
| 8,167,084 | B1 * | 5/2012 | Moore | 181/223 |
| 8,171,840 | B2 | 5/2012 | Kline et al. | |
| 2012/0255807 | A1 * | 10/2012 | Pieratti | 181/223 |

* cited by examiner

*Primary Examiner* — Jeremy Luks
(74) *Attorney, Agent, or Firm* — Law Office of Sam Sokhansanj PLLC; Sam Sokhansanj, Esq.

(57) ABSTRACT

A monolithic suppressor for suppressing sounds generated by the discharge of a firearm, wherein the discharge generates propellant gases. The monolithic suppressor includes a bore having a first end and a second end, the first end having an inlet aperture and the second end having an outlet aperture. In addition, a plurality of baffles are disposed within the bore, wherein the plurality of baffles further define a plurality of chambers. The chambers of the suppressor include at least an arcuate baffle and a slanted baffle. The plurality of chambers are configured to cause the propellant gases to spin in a plurality of vortices within one or more of the chambers thereby slowing the propagation of the gases within the suppressor.

17 Claims, 4 Drawing Sheets

MONOLITHIC FIREARM SUPPRESSOR

FIELD OF THE INVENTION

This invention relates to a sound suppressor for a firearm. More particularly, the invention relates to a firearm sound suppressor which influences the expanding gases associated with the discharge of a projectile from the muzzle of a firearm in a specific fashion to abate the noise otherwise associated with the firing of the firearm.

BACKGROUND

Traditionally, silencers (also referred to as suppressors) have been built with an outer tube and internal baffling components. The outer tube is steel or aluminum tubing and has end caps, either welded or threaded in place. The internal components are typically a set of flat disks each having a hole through the center thereof with spacers therebetween to create a volume of space (referred to as a baffle chamber) between each set of disks. Improvements on the flat spacer configuration include various expansion cone shape baffles that are either machined or stamped. Some of these baffles include holes at various places to re-direct gases and increase turbulence of the gases internally as the bullet passes thought the baffles. Such a configuration aids in reducing the noise produced by the firearm.

The pieces of the outer tube attach in a gas-tight manner onto, for example, an outside thread on the muzzle of a rifle. The disks extend in a plane that is orthogonal to the firing axis of the barrel. The firing opening of the disks can taper outward towards the front.

More modern suppressors that make use of what are referred to as "M" and "K" baffles incorporate both the expansion cone concept with the spacer as a single unit. These units are individually machined on a Computer Numerical Control (CNC) lathe and stacked on top of one another and are subject to stack-up tolerances during assembly. Recent designs include a monolithic baffle that is either drilled or milled from a round piece of stock. For example, U.S. Pat. Nos. 6,079,311 and 6,302,009 to O'Quinn et al. describe a monolithic baffle drilled or milled from a round piece of stock.

Characteristics of designing a suppressor include the number and the shape of the chamber parts. Each silencer also must be adapted to the weapon and to the ammunition used in the weapon. Another aspect to consider in this context is the silencer's sound-reducing requirements. Each chamber part reduces the muzzle report by a given amount and, therefore, a larger number of chambers is desirable. However, the silencer increases the total length of the firearm and adds weight to the muzzle (thus impairing the weapon's balance and line of sight), hence, the silencer should be as short and light as possible. The added weight disadvantage of the prior art suppressors significantly alters the firearm's point of impact (POI) when the suppressor is attached to the firearm. Hence, the user of the firearm is required to compensate for this change by "zeroing" the firearm's line of sight every time the suppressor is removed and/or attached.

The present invention overcomes the deficiencies of the prior art with a new and improved monolithic suppressor that is easier to manufacture, lighter in weight, and has better sound-reduction properties. More specifically, the firearm achieves improved sound-reducing properties over known prior art suppressors and is also shorter in length and lighter in weight. Hence, given the lighter weight and improved dimensions of the present invention's suppressor design, the firearm retains its POI after attaching the suppressor to the firearm, thereby precluding or minimizing the user's need to "zero" in his/her firearm's line of sight every time the suppressor is removed and/or attached. In addition, the present invention reduces and/or eliminates the sound contributed to "first round pop", which is a known in the art as a distinctly higher sound value for the first round of ammunition.

BRIEF SUMMARY OF THE INVENTION

The present invention provides, in one embodiment, a monolithic suppressor for suppressing sounds generated by the discharge of a firearm, the discharge generating propellant gases. The monolithic suppressor includes a bore having a first end and a second end, the first end having an inlet aperture and the second end having an outlet aperture. In addition, a plurality of baffles are disposed within the bore, wherein the plurality of baffles further define a plurality of chambers. The chambers of the suppressor include at least an arcuate baffle and a slanted baffle.

The present invention provides, in another embodiment, a method for suppressing sounds generated by the discharge of a firearm suppressor wherein the discharge generates propellant gases. The method further includes coupling the suppressor with a barrel of a firearm and receiving a bullet through the opening of the suppressor, wherein the suppressor has a plurality of chambers that are separated by a plurality of baffles. The method also includes receiving the propellant gases associated with the bullet in the plurality of chambers, wherein the configuration of the plurality of chambers cause the propellant gases to spin in a plurality of vortices within one or more of the chambers thereby slowing the propagation of the gases through the suppressor.

The above summary is not intended to describe each and every disclosed embodiment or every implementation of the disclosure. The Description that follows more particularly exemplifies the various illustrative embodiments.

DETAILED DESCRIPTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

In the various embodiments and figures of the invention, the suppressor is viewed in one orientation and the components and parts of the baffle described in the as shown and represented orientation. It would be obvious to one of ordinary skill in the art that the suppressor may be viewed and described from various other orientations and views. For example, if a component is described as being "upper" in an embodiment, it would be obvious that it would be interpreted as "lower" if the suppressor is viewed in an upside down (not shown) orientation.

Figure 1:
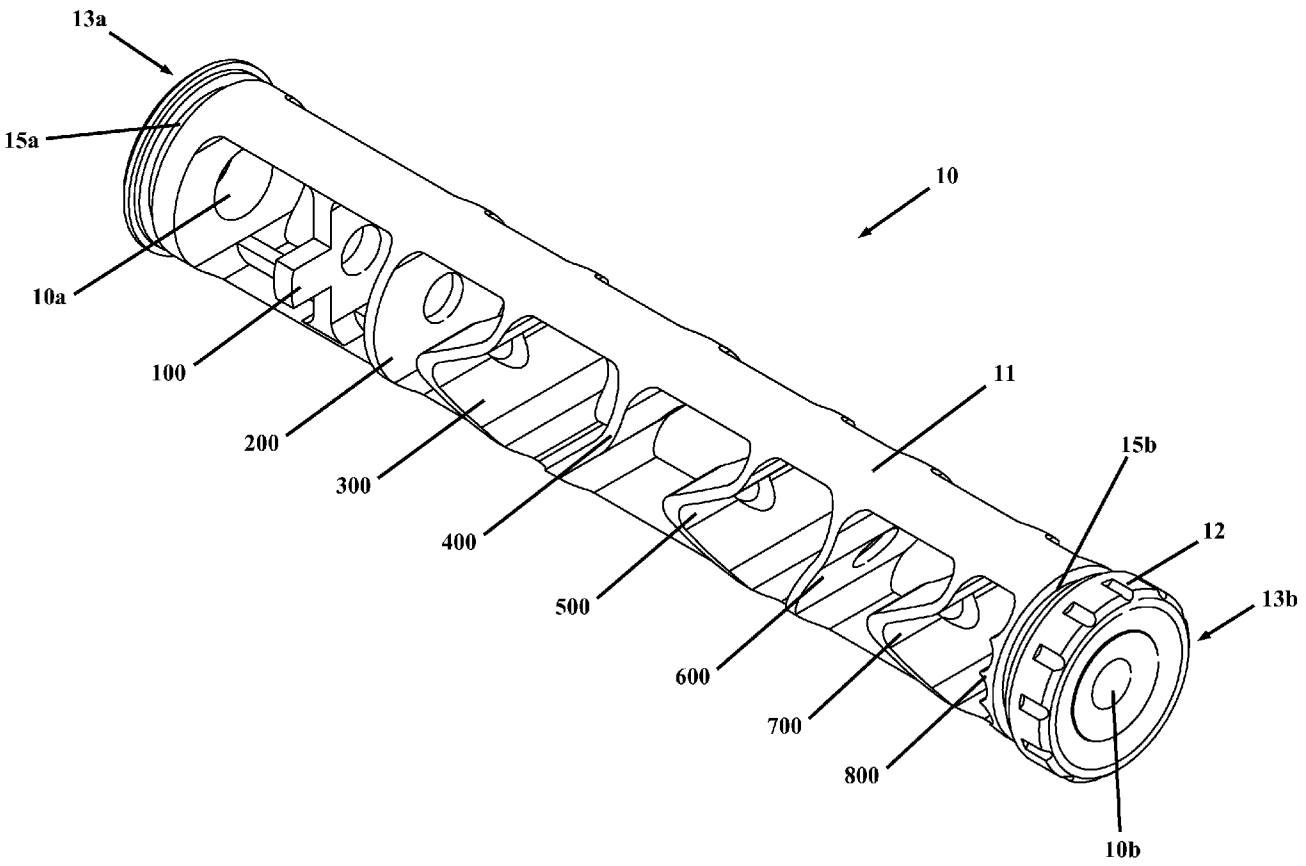
FIG. 1 illustrates an isometric top view of the suppressor.
Figure 2:
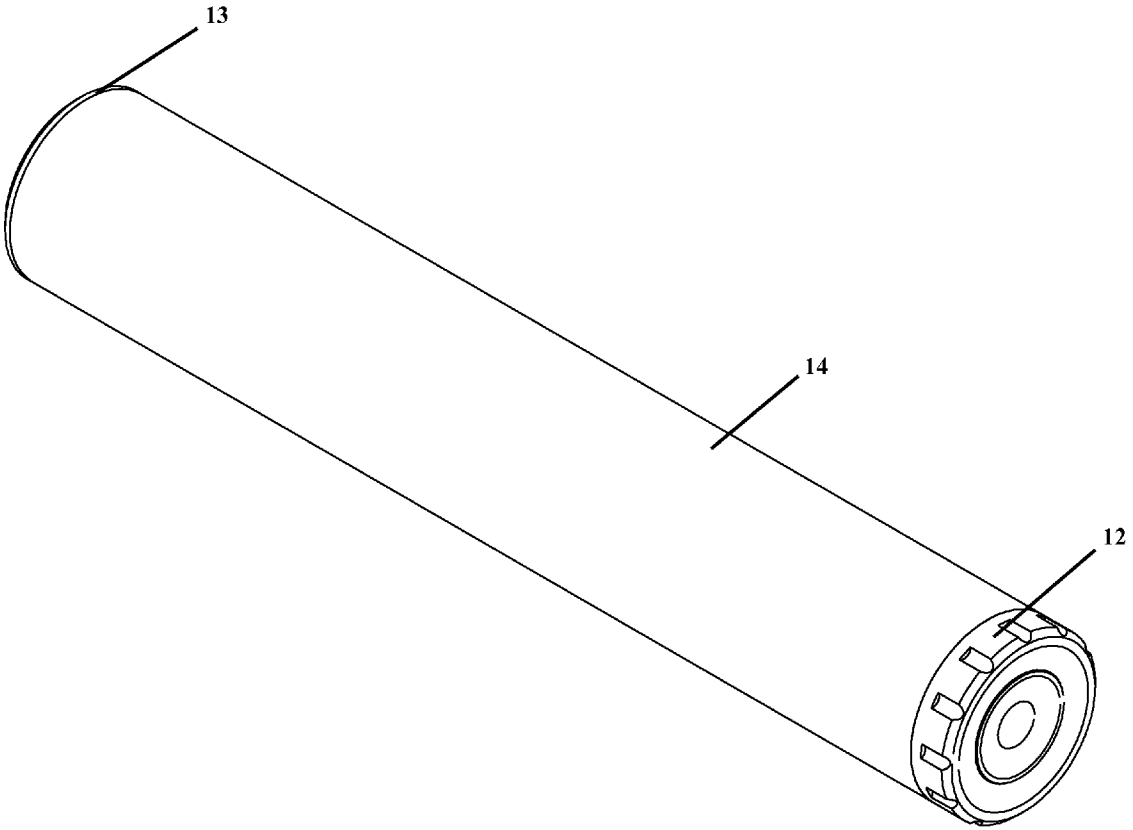
FIG. 2 illustrates an isometric top view of the suppressor with a sleeve.
Figure 3:
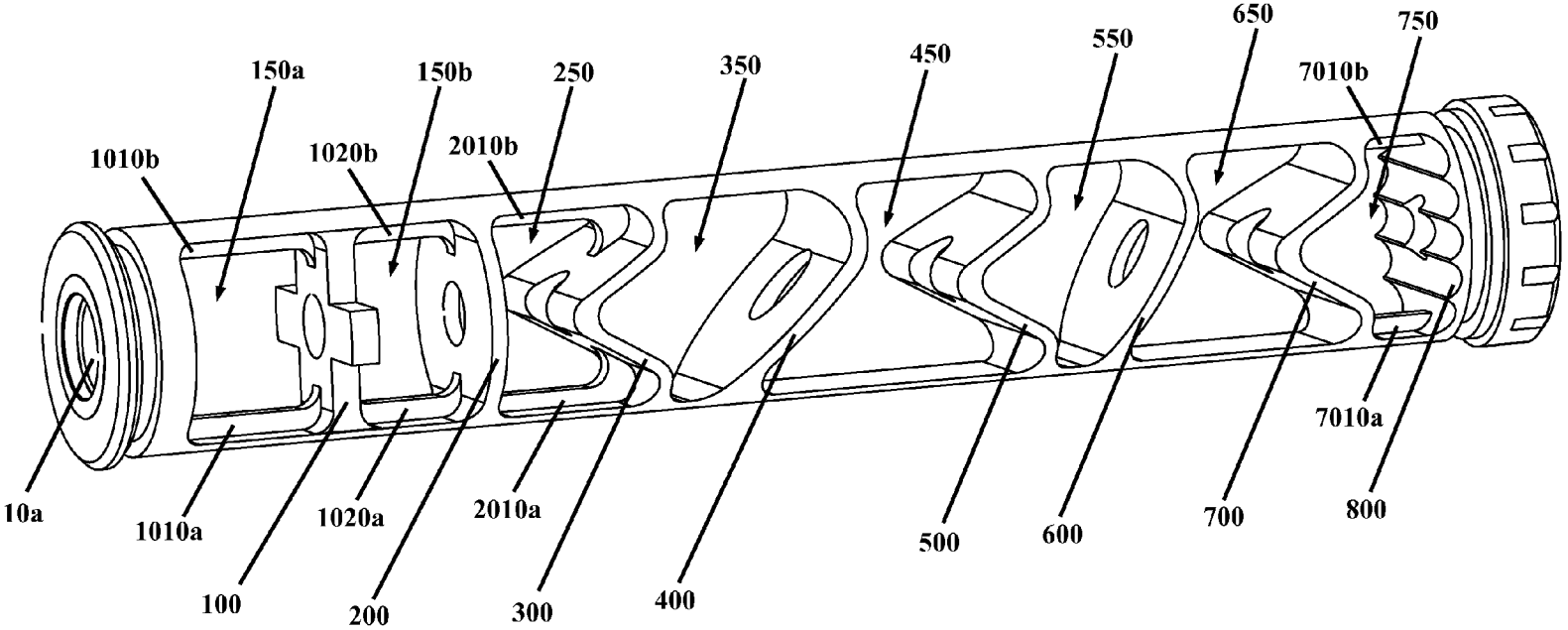
FIG. 3 illustrates an isometric right side view of the suppressor.
Figure 4:
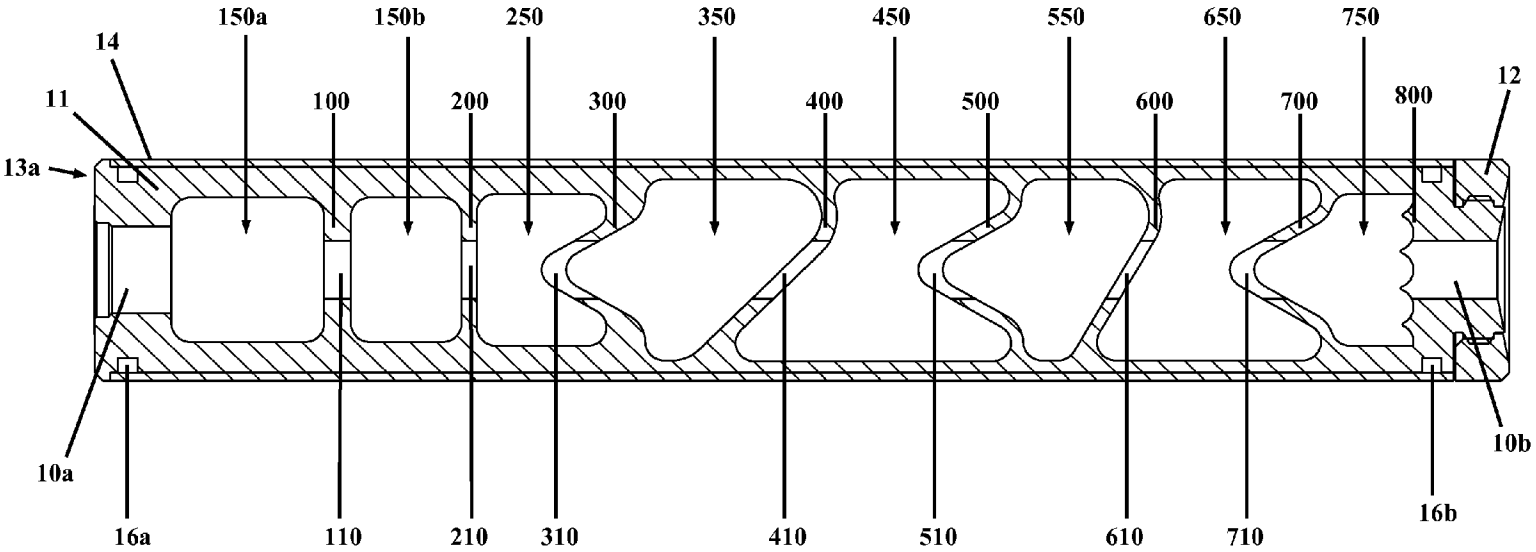
FIG. 4 illustrates a cross-sectional right side view of the suppressor.

A suppressor utilizing the concepts of the invention is illustrated in its entirety in FIG. 1-4, which illustrate one embodiment of the invention. The suppressor, generally designated by numeral 10, includes a cylindrical annular body having a cylindrical monolithic bore 11 having a first end 13*a* and second end 13*b*. It is contemplated within the scope of the invention that suppressor 10 or bore 11 may take any configuration other than cylindrical, such as a rectilinear, rectangular-like configuration, oval, ellipsoid, triangular, or any other tubular configuration having two or more sides. First end 13*a* allows for the bullet to enter suppressor 10 via aperture 10*a* and second end 13*b* allows for the bullet to exit suppressor 10 via aperture 10*b*. At first end 13*a*, the suppressor is suited with aperture 10*a* having an inner threaded surface that allows the suppressor to securely engage the barrel of a firearm (not shown), wherein the axially passage defined through the suppressor 10 is in alignment with the gun barrel. More specifically, as shown in FIG. 4, first end 10*a* is an aperture with a threaded inner surface that is proximal to the barrel of the firearm, thereby providing a secure threaded engagement with the barrel of the firearm. It is contemplated within the scope of the invention that aperture 10*a* may be configured to adapt to any type of firearm, depending on the firearm's properties, barrel dimensions, and/or suppressor desired. Further, in another embodiment, aperture 10*a* can provide a quick release or easily attachable and detachable feature from the barrel of the firearm. At second end 10*b*, the silencer is equipped with an end cap 12. Suppressor 10 is further adapted with a plurality of baffles 100, 200, 300, 400, 500, 600, 700, and 800. In the current embodiment, suppressor 10 and its respective components are made of titanium. However, it contemplated that suppressor 10 or either one or more of bore 11, sleeve 14, cap 12, and/or baffles 100-800 can be made of any suitable material, such as stainless steel, aluminum, titanium, metal alloys, copper, brass, or any appropriate metal. In the current embodiment, bore 11 and baffles 100-800 are molded as one-piece monocore or monolithic component and sleeve 14 and cap 12 as separate components. However, it is contemplated within the scope of the invention that any one or more of the baffles 100-800 may be independent components assembled within bore 11. Further, the bore may either be machined out of solid metal, stamped out of sheet metal, casted, molded, or produced from metal printing technique. The bore and baffles provide for a bullet pathway longitudinally through the center of baffles. The pathway can have a diameter that is at least 0.04 (1 mm) or larger than the bullet caliber to minimize the risk of the bullet hitting the baffles. Further, bore 11 can be approximately 3-14 inches in length and can be approximately 0.75-3.0 inches in diameter. It is contemplated within the scope of the invention that other dimensions for bore 11 and pathway may be appropriate depending on the type of firearm for which suppressor 10 is designed.

When a firearm is fired, propellant gases are generated that help propel the bullet out of the end of the firearm at a high velocity. Baffles 100-800 of bore 11 help retain and slow the propagation of the propellant gases as they travel through suppressor 10. Here, the arrangement between bore 11 and baffles 100-800 facilitate the one or more swirling, tornado pattern, or votex travel methods of the propellant gases as they travel through suppressor 10, thereby improving sound suppression and further increasing the velocity of the bullet as it exits the suppressor.

Referring now to FIG. 2 and FIG. 4, suppressor 10 is shown with an outer sleeve 14 enclosing the internal components of the suppressor, such as the inner bore 11 and baffles 100-800. Outer sleeve is a one piece component that slides over bore 11 via removal of end cap 12. In operation, end cap 12 may be unscrewed to remove sleeve 14 to allow access to bore 11, such as for cleaning purposes, wherein bore 11 may have built up propellant gas residue from extended use or foreign matter lodged within bore 11. Further, it is contemplated within the scope of the invention that the baffles and/or baffle arrangement may be later customized by allowing a user to remove sleeve 14. Bore 11 includes sealing rings 16*a* and 16*b* that are secured within annular recessed grooves 15*a* and 15*b*, respectively. It is contemplated that the sealing rings can be any type of ring that provides a seal, such as a square-ring, O-ring, quad-ring, metal seal, or lip seal. Further, sealing rings 16*a* and 16*b* can be of any material, including rubber, any metal or metallic material, titanium, copper, steel, nickel, Buna-N, Viton®, silicone, EPDM, Kalrez®, Markez®, Simriz®, Chemraz®, Aflas®, Teflon®, FEP, PFA, Fluorosilicone, urethane, HNBR, polyacrylate, Neoprene®, butyl, and/or hypalon. Sealing rings 16*a* and 16*b* provide a secure sealing arrangement for sleeve 14 that help in preventing the propellant gases from escaping bore 11. Sleeve 14 can be placed back on the suppressor by sliding it back on the bore wherein one end of sleeve 14 engages a projecting lip or flange around end 13*a* and the other end engages end cap 12 wherein end cap 12 is screwed on bore 11 via threaded engagement at end 13*b*. In other embodiments, sleeve 14 may be a two-piece or three or more piece component. Further, in other embodiments, there may be no sealing rings or alternatively one or three or more sealing rings depending on the suppressor desired.

The arrangement and configuration of baffles 100-800 will now be described in further detail. Referring now to FIG. 3 which illustrates an isometric right side view and FIG. 4 which illustrates a cross-sectional right side view, bore 11 further includes chambers 150*a*, 150*b*, 250, 350, 450, 550, 650, and 750, separated by one of baffles 100-800. As one skilled in the art will appreciate, the suppressor is configured to attach to the muzzle of a firearm such that the bullet pathway is substantially co-axial with the trajectory of the bullet as it exits the muzzle of the firearm. When the bullet exits the muzzle, it exits along with high velocity discharge gases that, in normal operation, exit the muzzle rapidly, which cause a loud noise. Noise suppressors, such as the one presented, are designed to dissipate the discharge gases that exit the muzzle of a firearm to reduce the level of noise being emitted. In the present suppressor, these discharge gases are dissipated via the adjacent chambers. Here, as the gases travels downstream through the bore and corresponding baffles and chambers, the baffle and chamber configurations of the present invention absorb and decelerate the gasses and the attendant audible frequencies created thereby.

Baffle 100 is the first baffle in the series of baffles that provide the initial suppression stage and is the most proximal to the barrel of the firearm. Baffle 100 is substantially perpendicular with respect to a central longitudinal axis and takes the shape of a "cross" having an aperture there-through and four open quadrants, wherein the openings of the four quadrants can be substantially equal in size. However, it is contemplated that baffle 100 can take any shape, size, or configuration such as a triangle, circle, oval, asymmetrical configuration, or any polygon having three or more sides, or slanted, curved, or arcuate. In the current embodiment, the configuration and shape of baffle 100 allows chambers 150*a* and 150*b* to be in fluid communication with each other via the four open quadrants of baffle 100 and the aperture. Chambers 150*a* and 150*b* are referred to as the "blast chambers", because they receive the initial blast from the plurality of gases following the bullet. The blast chambers 150*a* and 150*b* are proximal to the firearm, and are the first set of chambers that receive the bullet and associated gases from the barrel of the firearm. Accordingly, the gas pressures as received by the suppressor are the highest in these chambers, and these chambers are important in reducing the pressure and associated noise.

In the current embodiment, the spacing and arrangement of chambers 150*a* and 150*b* and baffle 100 allow sufficient space for the gases to spread and/or disperse in order to decrease the pressure of the gases for subsequent chambers. Further, the configuration and arrangement of chambers 150*a* and 150*b* significantly reduce or eliminate the "first round pop" (FRP) associated with prior art suppressors. FRP is very common in prior art suppressors due to a large amount of oxygen available to combust in the blast chambers. The present suppressor reduces or eliminates FRP by forcing the entering propellant gases to remain compressed together and move together around baffle 100 to at least partially prevent the gases from mixing with oxygen in one or both of chambers 150*a* and 150*b*. In addition, chamber 150*a* includes raised lower projection or rib 1010*a* and upper projection or rib 1010*b*, and chamber 150*b* includes raised projection or rib 1020*a* and upper projection or rib 1020*b*. Projections 1010*a*, 1010*b*, 1020*a*, and 1020*b* provide additional structural support for the baffles 100 and 200 because chambers 150*a* and 150*b* are under high stress from receiving the initial blast from the propellant gases. Ribs 1010*a*, 1010*b*, 1020*a*, and 1020*b* can also be referred to as I-beam supports. In operation, as the propellant gases that follow the bullet enter chamber 150*a* through aperture 10*a*, the configuration of baffle 100 forces the strong turbulent gases to be "sheared off" through the four spaced open quadrants of baffle 100 and also travel through aperture 110*b* and into chamber 150*b*. In the current embodiment, chamber 150*a* takes a square-like or rectilinear configuration which is slightly larger in volumetric space than chamber 150*b*, which takes an upstanding rectangular-like or rectilinear configuration. However, it is contemplated within the scope of the invention that any of chambers 150*a* and 150*b* can take any shape or configuration, and wherein their volumetric space may be substantially equal or chamber 150*a* may be larger in volumetric space than chamber 150*b*.

Once the propellant gases enter chamber 150*b* and additional pressure builds up, they begin to exit chamber 150*b* through aperture 210 of baffle 200. Baffle 200 is cylindrical or circular in shape and can be in any width or thickness suitable for the current suppressor. Baffle 200 can be called an "I" baffle, because it forms an "I" configuration when viewed from a cross-sectional side view and is substantially perpendicular with respect to a longitudinal central axis, as shown in FIG. 4. However, it is contemplated within the scope of the invention that baffle 200 may take any size, shape, or configuration.

After the propellant gases exit chamber 150*b*, they enter chamber 250. Chamber 250 is defined by baffles 200 and 300. In a cross-sectional right side view, as shown FIG. 4, chamber 250 takes the shape of an "M" configuration rotated 90 degrees counterclockwise. Further, baffle 300 takes on a rotated V-shape rotated 90 degrees clockwise, "M" configuration rotated 90 degrees clockwise, or arcuate configuration. In addition, chamber 250 further includes raised lower projection or rib 2010*a* and upper projection or rib 2010*b*. Projections 2010*a* and 2010*b* provide additional support for baffles 200, 300, and suppressor 10 due to the high stress received from the gas pressures. In addition, the projections provide overall structural support to the suppressor for extreme applications, such as in military or police use.

After the propellant gases exit chamber 250, they enter chamber 350. Chambers 350, 450, 550, and 650 are collectively referred to as the "vortex chambers". As the gases exit through aperture 310 they disperse within chamber 350, deflect off the surface of baffle 400, and travel upwardly along the inclined inner face of baffle 400. Baffle 400 takes the shape of a slanted "I" which can be angled at approximately 20-55 degrees with respect to a longitudinal central axis of bore 11. However, it is contemplated within the scope of the invention that baffle 400 can be at any angle depending on the caliber, firearm, or suppressor desired. The unique configuration of chamber 350 created by baffles 300 and 400, including the shapes and proportions that affect high and low pressure areas, allow the propellant gases to spin in a plurality of vortexes, vortices, or swirling patterns which promote slowing the propagation of the gases. As pressure builds up in chamber 350, the gases exit chamber 350 through aperture 410.

As the gases and their associated vortices enter chamber 450, they are directed downwardly to the bottom floor region of chamber 450 where they are then deflected upward towards the inner lower half region of baffle 500 where they can further deflect off the inner lower surface region of baffle 500, thereby creating a plurality of vortexes or swirling patterns in the lower half region of chamber 450. The gases further travel upward into upper half region of chamber 450 wherein they create additional vortexes or swirling patterns before traveling through aperture 510 of baffle 500. Baffle 500 takes on another rotated V-shape or backwards sigma "s" configuration, "M" configuration rotated 90 degrees clockwise, or arcuate configuration. More specifically, as shown in FIG. 4, and viewed from bottom to top, baffle 500 takes on a arcuate shape of a side-ways "V" or arcuate configuration, wherein the "V" is rotated 90 degrees to the right. The combination of baffle 400 and 500 form a rightward slanted or rightward skewed sigma "Σ" like configuration in the interior space of chamber 450.

Once the gases exit chamber 450 they enter chamber 550 via aperture 510 of baffle 500. As the gases exit through aperture 510 they disperse within chamber 550, deflect off the surface of baffle 600, and travel upwardly along the inclined inner face of baffle 600. Baffle 600 takes the shape of a slanted "I" which can be angled at approximately 33-77 degrees with respect to a longitudinal central axis of bore 11. However, it is contemplated within the scope of the invention that baffle 600 can be at any angle depending on the caliber, firearm, or suppressor desired. The unique configuration of chamber 550 created by baffles 500 and 600 allow the propellant gases to spin in a plurality of vortexes or swirling patterns which further promote slowing propagation of the gases. As pressure builds up in chamber 550, the gases exit chamber 550 through aperture 610.

As the gases enter chamber 650, they are directed downwardly to the bottom floor region of chamber 650 where they are deflected upward towards the inner lower half region of baffle 700 where they can further deflect off the inner surface lower region of baffle 700, thereby creating a plurality of vortexes or swirling patterns in the lower half region of chamber 650. The gases then travel upward into the upper half region of chamber 650 where they create additional vortexes before traveling through aperture 710 of baffle 700. Baffle 700 takes on another rotated V-shape rotated 90 degrees clockwise, "M" configuration rotated 90 degrees clockwise, or backwards sigma "Σ", or arcuate configuration. More specifically, as shown in FIG. 4, and viewed from bottom to top, baffle 700 takes on a "V" shape rotated 90 degrees clockwise or an arcuate configuration. The combination of baffles 600 and 700 form a rightward slanted or slightly rightward skewed sigma "Σ" like configuration in the interior space of chamber 650.

As further pressure builds up in chamber 650, the gases begin to exit through aperture 710 and into chamber 750. Within chamber 750, the remaining gases deflect upon the rippled surface of baffle 800 and propagate in a turbulent manner within chamber 750 before exiting chamber 750 through aperture 810 and into the atmosphere.

The nature in which the three components have been assembled allows for relatively easy dis-assembly. This may prove advantageous in efficient dis-assembly to service and/or replace selected components. For example, components of suppressor 10 may be removed for cleaning and/or inspection purposes. Those skilled in the art would appreciate that the repeated firing of ammunition may result in lead, carbon, or debris buildup inside a suppressor over time. Eventually, the lead, carbon, or debris buildup may be so severe that the suppressor is no longer functional or its performance is partially impaired. Sometimes the lead buildup may be so severe that a bullet may not be able to fit through the undersize hole in the baffle inside the suppressor. In addition to lead, carbon, or debris buildup, dirt or any other type of foreign matter may also be present inside the suppressor. Cleaning the various components of suppressor 10 on a regular or as-needed basis may help to reduce the lead and/or dirt buildup. The easy dis-assembly of suppressor 10 via sleeve 14 facilitates such cleaning.

Further, as discussed above, the various components of suppressor 10 may include threaded portions such that the components may be selectively secured with one another via the threaded portions, press-fit, screwed, rivets, bolts, or other known securement methods. Those skilled in the art would also appreciate that because suppressor 10 may be disassembled easily, any component of suppressor 10 may be customized in order to be used with various calibers of firearms. For example, the diameters of bore 11, baffles 100-800, and/or cap 12 may be altered and manufactured according to customer's specification. Similarly, the pitches and/or the diameters of the threaded portions of bore 11, or length, diameter, volume, apertures sizes of either of bore 11, sleeve 14, apertures 10*a* or 10*b*, baffles 100-800, chambers 150*a*-800, and cap 12 may be altered and manufactured according to customer's specification. In addition, it is contemplated within the scope of the invention that any of baffles 100-800 can take any shape, size, or configuration such as a triangular configuration, circle configuration, oval configuration, asymmetrical configuration, or any polygon configuration having three or more sides. Further, it is contemplated within the scope of the invention that the suppressor can include any number of baffles 100-800 and further any number of the baffles 100-800 arranged in other configurations with respect to each other. The ability to customize in this manner allows the various components described within this disclosure for suppressor 10 to be used with firearms of different manufacturers and also with different caliber firearms.

It will be apparent to those skilled in the art that various modifications and variations can be made in the disclosed suppressor. It will also be apparent to those skilled in the art that while the method of assembling a suppressor is disclosed with a specific order, that specific order is not required. Other embodiments will be apparent to those skilled in the art from consideration of the specification and practice of the disclosed embodiments herein. It is intended that the specification and examples be considered as exemplary only, with a true scope of the disclosure being indicated by the following claims.

What is claimed is:

1. A suppressor for suppressing sounds generated by the discharge of a firearm, the discharge generating propellant gases, the suppressor comprising:

a bore having a first end and a second end, the first end having an inlet aperture and the second end having an outlet aperture; and a plurality of baffles disposed within the bore, wherein a first baffle is in a slanted configuration, and a second baffle is in a curved configuration having a crest or trough in its middle region; and a chamber having a volumetric space, wherein the space is at least partially defined by the slanted configuration of the first baffle and the curved configuration of the second baffle.

2. The suppressor of claim 1, further comprising a removable end cap secured to the second end.

3. The suppressor of claim 1, further comprising a sleeve substantially enclosing the bore.

4. The suppressor of claim 1, wherein at least one baffle has a cross-shaped configuration having four open quadrants.

5. The suppressor of claim 1, where at least one baffle has a configuration that's configured to at least partially prevent gases from mixing with oxygen.

6. The suppressor of claim 4, wherein the cross-shaped baffle is configured to prevent propellant gases from mixing with oxygen.

7. The suppressor of claim 4, wherein the cross-shaped baffle is configured to substantially reduce the sound associated with a first round of ammunition fired through the suppressor.

8. The suppressor of claim 1, wherein the bore and baffles are a unitary monolithic component.

9. The suppressor of claim 1, wherein the plurality of baffles are configured to cause the propellant gases to generate a plurality of vortices as the propellant gases move from the first end towards the second end.

10. A suppressor for suppressing sounds generated by the discharge of a firearm, the discharge generating propellant gases, the suppressor comprising:

a bore having a first end and a second end, the first end having an inlet aperture and the second end having an outlet aperture;

a plurality of baffles disposed within the bore, wherein the plurality of baffles define a plurality of chambers; and wherein the plurality of baffles are further comprised of:

a perpendicular baffle configured to prevent the gases from mixing with oxygen;

a slanted baffle; and wherein the slanted baffle precedes an arcuate baffle having a crest or trough curvature in its middle area.

11. The suppressor of claim 10, wherein the bore and baffles are one monolithic component.

12. The suppressor of claim 10, wherein the plurality of baffles define a plurality of chambers, the plurality of chambers further comprising at least one of:

a parallelogram configuration;

a partial "M" configuration; and a partially skewed "Σ" configuration.

13. The suppressor of claim 10, wherein the plurality of baffles are configured to cause propellant gases to spin in a plurality of vortices as the propellant gases move from the first end towards the second end.

14. The suppressor of claim 10, wherein a plurality of vortices generated by the plurality of baffles cause the gases to slow their propagation through the suppressor.

15. A method for suppressing sounds generated by the discharge of a firearm suppressor, the discharge generating propellant gases, the method comprising:

receiving a bullet through an opening of the suppressor, wherein the suppressor comprises a plurality of chambers separated by a plurality of baffles;

receiving the propellant gases associated with the bullet in the plurality of chambers, wherein the configuration of the plurality of chambers cause the propellant gases to spin in a plurality of vortices within one or more of the chambers thereby slowing the propagation of the gases within the suppressor; and wherein a baffle having a cross-shaped configuration with four openings at least partially prevents the gases from mixing with oxygen in the one or more chambers.

16. The method of claim 15, wherein at least one of the plurality of chambers substantially prevent the propellant gases from mixing with oxygen thereby reducing the sound associated with the first bullet fired through the suppressor.

17. The method of claim 15, wherein the firearm suppressor is monolithic.

* * * * *